United States Patent [19]

Jaksha

[11] 4,445,958

[45] May 1, 1984

[54] INSULATIVE STRUCTURE

[76] Inventor: Jerome F. Jaksha, 5900 Deerhaven Rd., Lincoln, Nebr. 68516

[21] Appl. No.: 353,849

[22] Filed: Mar. 1, 1982

[51] Int. Cl.[3] ..... B31F 3/00

[52] U.S. Cl. ..... 156/211; 156/216; 156/227; 156/297; 156/300; 160/133; 160/230

[58] Field of Search 160/25, 32, 133, 130, 160/229 R, 230, 231 R, 231 A, 232; 156/226, 156/227, 216, 552, 212, 213, 211, 297, 300, 65, 562

[56] References Cited

U.S. PATENT DOCUMENTS

| | | | |
|---|---|---|---|
| 2,025,926 | 12/1935 | Winter | 160/230 |
| 2,528,829 | 11/1950 | Hintersteiner | 160/231 R |
| 2,564,197 | 8/1951 | Dobkin | 160/230 X |
| 3,084,403 | 4/1963 | Elmendorf | 160/133 |
| 3,611,655 | 10/1971 | Loebner | 160/133 X |

*Primary Examiner*—David A. Simmons

*Attorney, Agent, or Firm*—Vincent L. Carney

[57] ABSTRACT

To insulate a window, the bottoms, the ends and a portion of the tops near the ends of a plurality of relatively-thick, relatively-stiff polyurethane strips are cemented to a flexible fabric by an elastomer. The maximum width of the polyurethane strips increases with their position along the fabric as the square root of a function of the stretching ability of the elastomeric cement and the radius from the center of the roller to the strip. That function includes the difference between the square of a first quantity and a second quantity, the first quantity being the sum of the radius of the particular rolled end and the stretching ability of the elastomer at the edge of the strip and the second quantity being the radius squared. The uppermost polyurethane strip forms a sealing engagement with the sill, the two sides of the backing and the ends of the strips ride in sealing tracks and the bottom strip rests on the sill to form a compartment with the window.

12 Claims, 5 Drawing Figures

FIG. 3
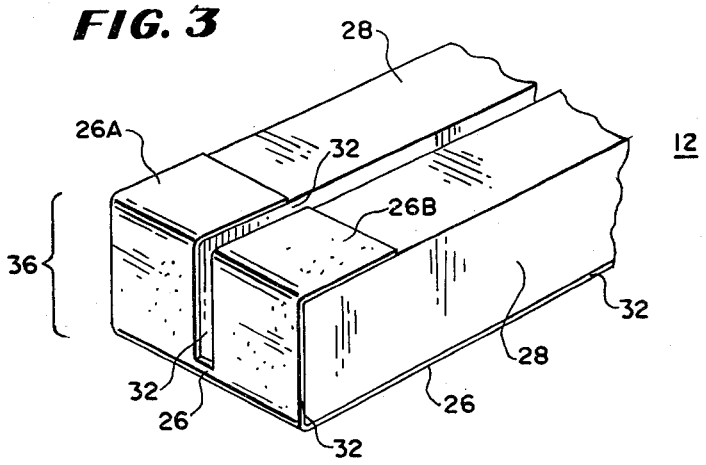
FIG. 4
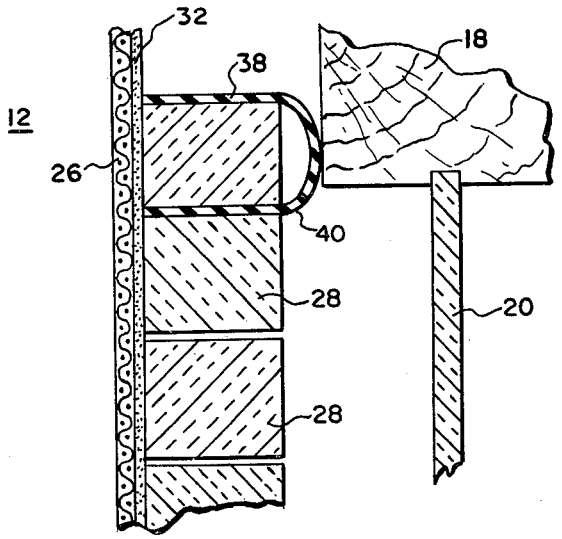
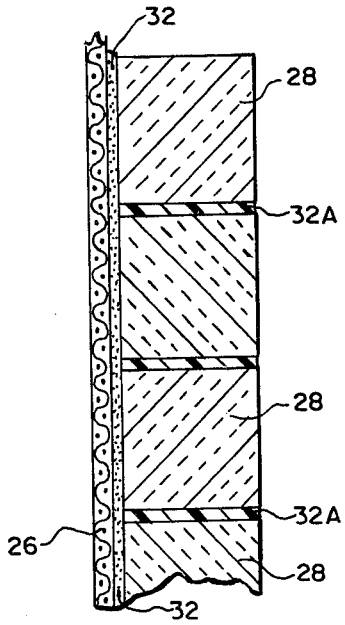
FIG. 5

INSULATIVE STRUCTURE

BACKGROUND OF THE INVENTION

This invention relates to insulating structures.

In one class of insulating structures, a plurality of solid, relatively-stiff, relatively-thick insulative strips are fastened to a single flexible backing larger than any one of the insulators so that the entire assembly may be pulled around a corner. This assembly may be lowered to cover a structural member such as a window or raised to uncover it.

In one prior art type of insulator of this class, the insulative strips are fastened to the flexible backing in a way that permits some flexing.

The prior art type of insulating structure has several disadvantages, such as: (1) it can only be pulled around gentle curves and thus must occupy an amount of space substantially the same as when it covers the structural member even though it is in a different position; (2) when it is over the structural member, drafts are created between the insulator and the structural member such as a window caused by the cooling of air within the space between the two and, under some circumstances, a chimney effect is created; and (3) there is a tendency for the strips to be loosened or to be pulled free from the flexible backing.

SUMMARY OF THE INVENTION

Accordingly, it is an object of the invention to provide a novel insulative sheet.

It is a still further object of the invention to provide a flexible insulator which includes solid relatively-stiff, relatively-thick insulative members in which the members are attached to resist being pulled free.

It is a further object of the invention to provide a flexible insulator which may be folded over itself to conserve space.

It is a still further object of the invention to provide a flexible sheet of solid insulators which may be wound in a roll.

It is a still further object of the invention to provide a durable, long-lived flexible insulator.

It is a still further object of the invention to provide an insulator in which a flexible backing has stiff members attached to it by an elastomer in such a way that the entire assembly may be bent around relatively sharp corners without the stiff members being pulled free from the backing.

It is a still further object of the invention to provide a solid, easily-removable insulator which maintains a sealed compartment around a structural member such as a window when it is in position.

In accordance with the above and further objects of the invention, a flexible insulating member is formed from a flexible sheet which has fastened to it a plurality of strips of solid, relatively-stiff insulative members in such a way as to permit the entire assembly to be placed in overlapping relationship and thus use less space when it is removed from the area that is to be insulated.

Advantageously, connection between the insulative strips and the flexible backing is stretchable, which in the preferred embodiment is achieved, at least in part, through the use of an elastomeric cement. The strips of stiff insulating material are of such a size to permit rolling in a relatively tight spiral. In one embodiment, the strips near the bottom are larger than those near the top to avoid having an excessive number of strips and spaces between the strips. In another embodiment, the strips are of equal width or in groups of equal-width strips, each group increasing in width.

The width of each of the strips is no greater than the square root of a function of the radius of the roll to the stiff insulating strip at its center and the amount that the cement can stretch at the edge of the strip. That function is the sum of a first and a second quantity, the first quantity being four times the square of the amount of stretching at the edge and the second quantity being the product of the radius and the stretching multiplied by eight. The width should always be less than this.

To achieve better adhesion of the backing material to the insulators, the backing material is cut with fingers of material at the ends, which fingers may be folded over the insulating strips for a better connection. The edges of the flexible material and the ends of the strips ride in tracks to form a seal along the sides with the bottom strip resting against a bottom member to seal the bottom and the top strip abutting against an upward structural member to form an enclosure between the material of the structure to be insulated and the flexible insulator.

To prevent the strips from pulling free of the flexible backing when wound in a roll, the width of a strip should be no greater than two multiplied by the square root of the sum of first, second, third and fourth quantities. The first quantity is the square of the amount of permissible stretching, the second is the product of the permissible stretching by the length divided by the product of the number of turns on the roll and pi, the third is the product of the permissible stretching, the number of turns and the thickness of a single sheet of insulation and the fourth is a negative product of the thickness of a single sheet and the permissible stretching.

From the above description, it can be seen that the flexible insulator has several advantages such as: (1) it is relatively inexpensive; (2) it is durable; (3) it is possible to cause it to overlap so as to save space; (4) it can be wound in a roll without tending to force the strips to fall free; and (5) it can have a relatively small number of solid insulative strips.

SUMMARY OF THE DRAWINGS

The above noted and other features of the invention will be better understood from the following detailed description when considered in connection with the accompanying drawings, in which:

FIG. 3 is a fragmentary, simplified perspective view of a portion of the embodiment of FIG. 1;

FIG. 4 is a sectional, fragmentary view of a portion of the embodiment of FIG. 1; and FIG. 5 is a sectional view of another embodiment of a portion of the embodiment of FIG. 1.

DETAILED DESCRIPTION

Figure 1:
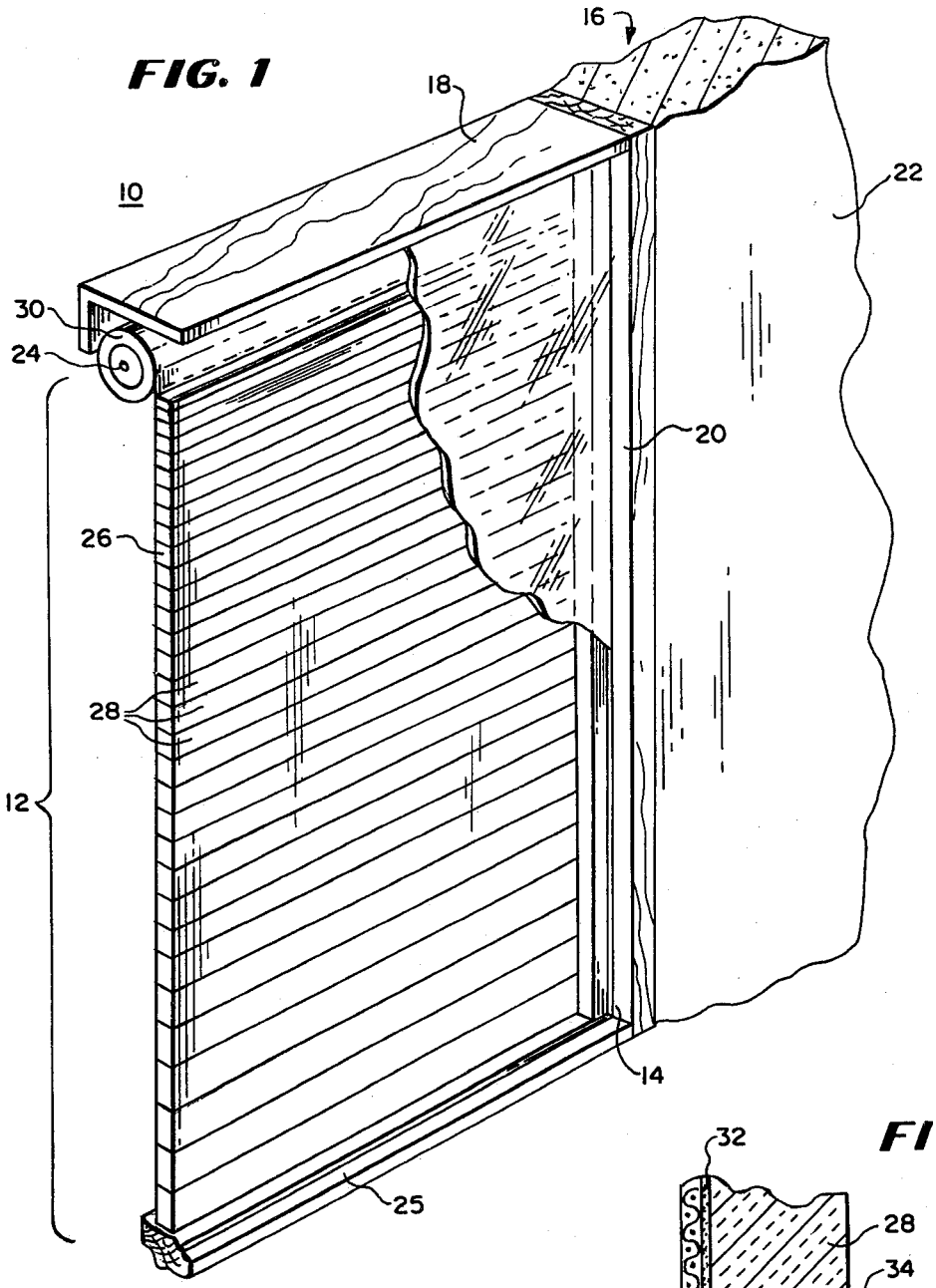
FIG. 1 is a simplified perspective view, partly broken away of an insulated structure in accordance with an embodiment of the invention.

In FIG. 1, there is shown a fragmentary, perspective view of an insulated building structure 10 having a flexible insulator sheet 12, an insulator track 14 and a window 16. The flexible insulator sheet 12 is mounted adjacent to the window 16 and may be pulled to cover it. As it is raised and lowered, each end rides within a corresponding one of two parallel insulator tracks positioned in the inside of the building from the window 16, such as the track shown at 14.

The window 16 includes a top framed portion 18, side framed portion 22, a sill 25 and a glass portion 20, with the track 14 being along the side framed portion 22. With this relationship, the flexible insulator sheet 12 is mounted to cover the glass portion 20 and to form a sealing relationship by means of the insulator track 14 with the framed portions 18, 22, and 25.

The flexible insulator sheet 12 includes a shade roller 24 with a flexible sheet portion wound around it. The flexible sheet portion includes a flexible fabric backing 26 and a plurality of relatively thick insulative strips certain of which are shown at 28. The shade roller 24 may be any spring-loaded roller for winding the flexible insulator therearound so that it can be pulled down when it is desired to insulate the glass portion 20 of the window 16 and raised when it is desirable to permit light to enter the window 16.

The flexible fabric backing 26 is any suitable flexible sheet and is designed to be relatively attractive in appearance from the inside of the window.

The insulative strips 28 may be any suitable form of insulation cut in strips of uniform thickness in the direction orthogonal to the flexible backing 26 of a length equal to the length of the flexible insulator sheet 12 to extend across the window and of a width which differs in relationship to the distance of the individual strip from the shade roller 24 so that the strips or groups of strips which are on the outside of the roll when its wound, are wider than those which are adjacent to the roll. The insulative strips 28 may be of any suitable material such as, for example, polyurethane foam or the like fastened to the fabric by any suitable means that provides some flexibility of connection.

The insulative strips 28 are positioned to abutt each other to form a solid insulation of reasonable thickness when they are over the window in straight, uncurved, unrolled relationship. The adjacent edges may be of any complimentary form to provide interfitting but are generally straight across the flexible insulative sheet 12 and orthogonal to the flexible fabric backing 26 for convenience.

The width is such that when the insulative strips 28 are collectively wound in a roll with their backing, the tension between the flexible backing and edges of the rigid insulative strips does not exceed the elastic limits of the connection between the flexible backing and the stiff insulative strips. Since the amount of pulling of the ends of the flexible fabric backing 26 with respect to the insulative strips 28 is related to the radius of the bottom of the insulative strips 28 (the side which is attached to the flexible fabric backing 26) illustrated for one layer of the roll at 30, the insulative strips 28 may be wider near the bottom than near the top.

The tension between the flexible fabric backing 26 and the insulative strips 28 at the edge of the strips occurs because the distance from the center of the shade roller 24 to the edges of the insulative strips 28 exceeds the radius of the roller to the bottom of the strip at a center location. Thus, the amount of pulling can be derived from a consideration of the right angle square root law. The radius of the total distance of the fabric connected to the edge of a strip is equal to the square root of the sum of the square of the radius to a center point plus the square of the fraction equal to the width divided by two. Since the stretching is equal to the distance to the edge point of the insulative strip 28 minus the radius, the amount of required stretching is equal to the square root of the square of the radius plus the square of the fraction which is equal to the width divided by two minus the radius.

From this relationship it can be seen that the greater the width is, the greater the amount of stretching but the greater the radius for the same width, the less the stretching. Consequently, the width may be increased to keep the amount of stretching constant by an amount that is two times the square root of a first quantity squared minus the square of the radius. The first quantity which is squared is the amount of stretching permitted by the connection between the edge of the insulative strips 28 and the flexible fabric backing 26 plus the radius.

For manufacturing convenience, it may be desirable to have uniform sized strips of insulation. The width must be selected under the most severe condition which is near the top of the unraveled sheet or the center of the wound roll. Instead of complete uniformity, groups of strips of the same size may be used but the relationship described above is taken as a limit with the strips being no wider than the square root of a function of the radius of the roll to the strip at its center and the amount that the binding can stretch at the edge of the strip. That function is the sum of a first and a second quantity, the first quantity being four times the square of the amount of stretching at the edge and the second quantity being the product of the radius and the stretching at the edge multiplied by eight.

The width should be no greater than two multiplied by the square root of the sum of a first, second, third and fourth quantities. The first quantity is the square of the amount of permissable stretching and the second is the product of the permissable stretching by the length divided by the product of the number of turns on the roll and pi, the third is the product of the permissable stretching, the number of turns and the thickness of a single sheet of insulation and the fourth is a negative product of the thickness of a single sheet and the permissable stretching.

The insulated building structure of this invention hss several advantages such as: (1) it is adjustable to permit light or air or the like to enter at times; (2) it is economical; (3) it is designed to be thermally efficient and yet structurally strong; and (4) it provides efficient sealing against conduction and convection of heat.

While the building structure described in FIG. 1 is for a window, it is obvious that the invention may be used for other structures such as doorways or openings or the like in a house, garage or other building structure as desired. Moreover, different devices for rolling and unrolling the insulator may be used.

Figure 2:
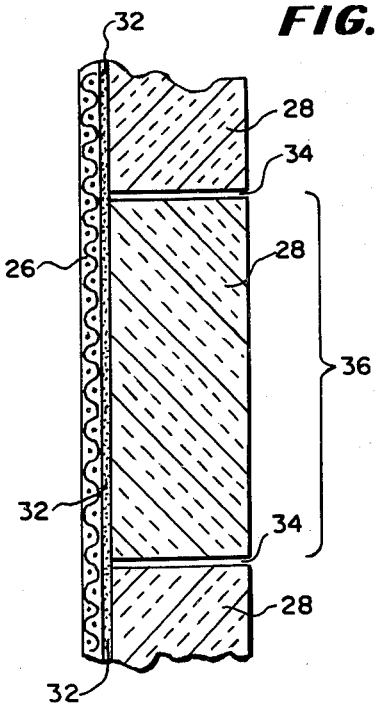
FIG. 2 is a fragmentary, sectional view of an embodiment of FIG. 1.

In FIG. 2, there is shown an enlarged, sectional fragmentary view of one of the strips of insulation 28 and adjoining fragments of two others. The insulative strips 28 are bonded by an elastomeric cement 32 to the flexible fabric backing 26. As shown in this view, there is a very small space 34 between individual strips of insulation 28, each of which have a different width, one of which having its width indicated as at 36.

The yield point of the cement 32 may be sufficient to permit the winding of the flexible sheet insulation 12 (FIG. 1) around the shade roller 24 without yielding and thus weakening the attachment to the insulative strips 28. Moreover, the modulus of elasticity must be sufficient to permit stretching so as to accomodate the winding around the shade roller 24. The flexible fabric backing 26 must be strong enough to support the weight of the insulative strips 28 and the insulative strips 28 must be sufficiently large to provide adequate heat insulation.

The spaces 34 between the insulative strips 28 such as that shown at 36 must be sufficiently small to prevent a substantial amount of cool air, particularly moisturized air, from penetrating through the flexible fabric backing 26. Moreover, the space has to be sufficiently small so that the fabric adjacent to the space is not cooled to the extent that moisture within the house freezes in a strip along the inside of the flexible fabric backing 16. This type of freezing tends to provide a change in dimensions which promotes freeing of the insulative strips 26 or cracking of the fabric due to ice formation.

In FIG. 3, there is shown a fragmentary perspective view of an end of two of the insulative strips 28 fastened to a portion of the flexible fabric backing 26 by cement 32. As shown in this view, the insulative strips 28 are all of a uniform height indicated at 36 and are mounted at their ends to individual flaps 26A and 26B being shown in FIG. 3. The flaps such as 26A and 26B are wrapped around the outer ends and a portion of the top of the insulators. Indeed, they may extend across the entire length of the insulator but when they are covering only a portion, as shown in FIG. 3, they are of matching color to the insulative strips 28 to preserve an appropriate appearance.

The flaps 26A and 26B are cemented by the same cement 32 but other cements may be used. Although the flaps 26A and 26B are integral part of the fabric 26 in the embodiment of FIG. 3, they, of course, may be separate pieces of fabric cemented to overlap the fabric backing 26 and extend around the edges of the strip 28. The purpose of these flaps is to prevent the flexible fabric backing 26 from peeling away at the edges of the insulative strips 28 because of the increased stress between the two at these points during use. The extra surface of attachment is required for a number of reasons including that the edges ride in the track 14 (FIG. 1) causing extra shear stretches and there is a concentration of stresses at corners. The combined stresses combine to cause a start of the removal of the strips at the corners, which separation may later extend along the length of the insulative strips 28 to cause them to fall free.

In FIG. 4, there is shown a fragmentary, sectional view of the flexible sheet 12 having two of the insulative strips 28 mounted to the flexible fabric backing 26 and the uppermost insulative strip 38 mounted near the top and adjacent to the shade roller 24 where it engages the wood window frame 18 to provide a seal between the top of the insulative sheet 12 and the window 16. This seal prevents cold air between the glass 20 of the window 16 and the flexible insulating sheet 12 from escaping into the room.

The insulative strip 38 has the same length and an appropriately designed width as the strips 34 but its height is extended by a "U" shaped rubber backing end member 40 which fits over the end insulative strip 38 to engage the length of the top wood window frame 18 to provide the seal. Thus, the bottommost strip 28 against the sill, the track 14 on either side of the insulative strip 34 and the rubber backing member 40 form an enclosed compartment which seals any cold air created by conduction through the glass 20 from entering the building. In the alternative, a strip attached at one end to the top wood frame 18 and at the other end to the insulative strip 38 may be used. Of course, other shaped members may be used and the extension may instead be attached to the wood window frame 18 to form a seal between the window 16 and the insulative strips 28.

In FIG. 5, there is shown another embodiment of flexible insulative member 12A showing several insulative strips 28 attached to the flexible fabric backing 26 by an elastomeric fastener or cement 32. In the embodiment of FIG. 5, there is also a connecting material 32A between the strips and this connecting material is capable of contraction and expansion. It may be an elastomeric adhesive that permits expansion so that the flexible strip may be wound around the roll or it may be some other material such as a flexible fabric-type material that folds between the strips when the insulation is covering a structural member in planner relationship and expands when pulled outwardly for rolling about a roll.

In use, the flexible insulator sheet 12 is fabricated to fit within a particular structure such as a window 16 and after fabrication is mounted to the structure. When mounted, it may be pulled down to serve as insulation or raised to permit light or air or the like to enter the structure depending on the type of opening or structure it covers.

In fabricating the flexible insulator sheet 12, the flexible fabric backing 26 and an insulative board are cut into sheets and attached with the board being cut into strips and the fabric cut to have serated end portions forming the flaps 26A on each of two parallel edges. The length of the insulative sheet 12 is slightly longer than the height of the structure to be covered and its width should correspond to the structure.

A panel of solid insulating material such as polyurethane is glued to the fabric and then cut into strips each having a width which corresponds to its position along the board. The thickness is suitable to provide proper insulative characteristics.

In the alternative, strips of solid insulating material are each cut to a width which differs in accordance with its position along the fabric and all of which have a thickness suitable to provide adequate insulating characteristics.

The length of the strips in either case corresponds to the width of the fabric except for the flaps 26A. In the preferred embodiment, the strips are approximately one inch thick and three feet long. The thickness is selected to provide enough insulation to prevent the elastomeric material from freezing.

After cutting to size, the board in the first embodiment and each of the insulative strips 28 in the second embodiment are coated on one side with an elastomeric cement and are place adjacent to each other one by one on the fabric. The flaps 26A are then coated and folded over both of the ends of each of the insulative strips 28. When this is done, a flexible member has been formed which consists of solid polyurethane insulative strips 28 placed side by side on a flexible fabric backing 26 to permit bending about one end.

The first method of fabrication provides the advantages of more readily obtaining: (1) zero space between the strips 28; (2) fast and easy production; (3) reduced alignment problems; (4) an additional vapor barrier from the original foil barrier on the insulating board; and (5) uniformity of the thickness of the strips 28.

The upper end of this flexible member, after the cement has hardened, is attached to the shade roller 24 and the shade roller 24 mounted to the structure. Each of the ends of the flexible strip, including the ends of each of the insulative strips 28, rests within tracks 14 which are vertical and run parallel from a height that is substantially equivalent to that of the shade roller 24 to the bottom of the structure to be covered so as to form a sealing relationship when the flexible insulating sheet 12 is pulled down.

In use after attachment, when it is desired to permit light to enter a window or air to pass through an opening or the like, the flexible insulator sheet 12 is raised in the manner of a window shade to uncover the opening. When it is desired to permit insulation, such as at night, it is pulled downwardly. When it is pulled downwardly, the pointed member 38 engages an upper frame member 18 of the window to provide a seal together with the tracks 14 and the insulative strips 28 which rests upon the sill. When in this position, a compartment is formed about the structure to be covered.

As can be understood from the above description, the insulative structure of this invention has several advantages such as: (1) it is simple and economical to fabricate; (2) it is sturdy and resists the accidental freeing of the solid insulative strips 28; (3) it forms a sealing compartment together with the window or other structure; (4) the solid strips are not pulled free by bending of the member when it is wound on a roll; and (5) it may be conveniently raised or lowered or pulled from side to side if mounted vertically to cover and uncover the structure.

Although a specific embodiment of the invention has been described with some particularity, many modifications and variations of the preferred embodiment are possible without deviating from the invention. Therefore, it is to be understood, within the scope of the appended claims, the invention may be practiced other than as specifically described.

What is claimed is:

1. A method of insulating a window comprising the steps of:

cutting a flexible fabric into a substantially rectangular backing sheet having two parallel long sides and two parallel short sides with the two parallel long sides each having a different plurality of fingers of fabric extending therefrom;

cutting strips of solid stiff insulator having a length equal to said short sides and a width equal to the width of certain of said fingers of fabric;

applying an elastomeric cement between one side of each said plurality of solid insulative strips and said fabric;

fastening with said elastomeric cement said strips of solid insulator in parallel relationship to each other with their long sides adjacent to each other onto said flexible fabric with the ends of the insulators terminating at said extending fingers;

applying an adhesive to the fingers and folding them over the insulative strips, whereby each strip is held by elastomeric cement to the main body of the fabric and to the fingers;

the steps of cutting and fastening said strips of solid stiff insulators including the step of cutting insulators of different widths and fastening them in a relationship in which the smaller widths are at one end and the larger widths at the other of the flexible backing;

attaching the end of said flexible backing having the smaller width insulators to a curtain roller, whereby the fabric with insulators attached may be roller upon the curtain roller;

mounting said roller to a window;

pulling said backing strips down to form an insulator adjacent to the window; and raising said backing and strips to permit light to pass through said window.

2. A method according to claim 1 in which the steps of cutting and fastening the insulating strips includes the step of: cutting said strips so that they each have a width no wider than a function of the radius from the center of the roller to the center of the width of the insulative strip and the amount of stretching required at an edge of the insulative strip when wound on the roll, said function being the square root of the difference between a first quantity and a second quantity, the first quantity being four times the square of the sum of the radius and the amount of stretching of the elastomeric material required and the second quantity being the square of the radius.

3. A method according to claim 2 in which the step of fastening said insulators includes the step of fastening an insulator at the top in such a way that it forms a sealing relationship with the top of the window.

4. A method according to claim 3 in which the step of mounting said roller includes the step of mounting said roller with the edges of said flexible fabric and insulative strips within a track, whereby when it is pulled down, its edges move along the track and when it is lifted, the edges move upward along the track.

5. A method according to claim 4 in which the step of pulling said insulative member down includes the step of pulling it down until the widest of the insulator rests against the sill of the window, whereby a compartment is formed between the window and the flexible member, substantially sealed at the top by said top member abutting a member above the window, at the bottom by the bottom insulator abutting the seal and at each side by the edges of the insulators within said parallel tracks.

6. A method according to claim 5 in which the step of cutting strips includes the step of cutting strips with the width of each strip being no greater than two multiplied by the square root of the sum of a first, second, third and fourth quantities. The first quantity being the square of the amount of permissable stretching, the second being the product of the permissable stretching and the length divided by the product of the number of turns an the roll and pi, the third being the product of the permissable stretching, the number of turns and the thickness of a single sheet of insulation, and the fourth being a negative product of the thickness of a single sheet and the permissable stretching.

7. A method of making an insulator comprising the steps of:

obtaining a plurality of solid insulators each being of a predetermined size; and fastening said solid insulators to a flexible fabric in side-by-side relationship with insulators at a first end being no larger than the insulator at the other end, the width of the insulators at said first end being related to their distance from said second end and when said member is rolled, being no wider than the square root of a function of the radius of the roll to the strip at its center and the amount that the binding of the strips to the fabric can stretch at the edge of the strip, which function is the sum of a first and a second quantity, the first quantity being four times the square of the amount of stretching at the edge and the second quantity being the product of the radius and the stretching at the edge multiplied by eight.

8. A method according to claim 7 further including the step of selectively moving said fabric over a structure to be insulated to provide thermo-insulation and away from said structure by overlapping said fabric over itself.

9. A method according to claim 8 in which the step of moving said fabric away from said structure by overlapping it includes the step of overlapping said fabric so that the outermost portions of the fabric contain the larger insulators.

10. A method according to claim 8 in which the step of overlapping comprises the steps of:

rolling said fabric onto a roll; and the step of fastening said members to said fabric includes the step of fastening the members with an elastomeric material with the fasteners being arranged so that their widths are, in size, a function of the distance from the center of the roll to the center of the fastener and the amount of stretching of the elastomer at the edges of the fastener.

11. A method according to claim 10 in which the step of fastening includes the step of fastening said insulators so that the width is no wider than the square root of a function of the radius of the roll to the strip at its center and the amount that the binding of the strips to the fabric can stretch at the edge of the strip, which function is the sum of a first and a second quantity, the first quantity being four times the square of the amount of stretching at the edge and the second quantity being the product of the radius and the stretching at the edge multiplied by eight.

12. A method according to claim 11 further including the step of attaching said roll to the top of a window.

* * * * *